US006283579B1

(12) United States Patent
Haga et al.

(10) Patent No.: US 6,283,579 B1
(45) **Date of Patent: *Sep. 4, 2001**

(54) RECORDING HEAD

(75) Inventors: Koichi Haga; Hiroaki Satoh; Ichirou Asai; Jiro Minabe, all of Nakai-machi (JP)

(73) Assignee: Fuji Xerox Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/099,782

(22) Filed: Jun. 19, 1998

(30) Foreign Application Priority Data

Jun. 23, 1997 (JP) ..... 9-183118

(51) Int. Cl.[7] ..... B41J 2/135
(52) U.S. Cl. ..... 347/46
(58) Field of Search ..... 347/46

(56) References Cited

U.S. PATENT DOCUMENTS 4,308,547 12/1981 Lovelady et al. .
5,917,521 * 6/1999 Haga et al. ..... 347/46

FOREIGN PATENT DOCUMENTS

A-3-154665 7/1991 (JP) .
A-3-200199 9/1991 (JP) .
B2-2-6-45233 6/1994 (JP) .
A-6-340070 12/1994 (JP) .

OTHER PUBLICATIONS

Chikashi Chiba, Sankaido Publishing Co., Ltd., 1990, §2, pp. 166–172.

* cited by examiner

*Primary Examiner*—John Barlow
*Assistant Examiner*—Michael S. Brooke
(74) *Attorney, Agent, or Firm*—Oliff & Berridge, PLC

(57) ABSTRACT

A recording head for carrying out printing by jetting ink drops for deposition at predetermined positions on recording media, and allowing minute drops to be jetted without using a nozzle to record high-definition images. The recording head includes an elastic member vibrating in response to the excitation of a vibration generating means vibrating in accordance with a pixel signal, wherein capillary waves are generated on the surface of ink by the vibration of the elastic member to jet the ink for deposition on recording media. The elastic member is of a cantilever construction that bending vibration is made by excitation. Also, the elastic member has a length of about $2\lambda$ as the width of a side perpendicular to a vibration direction of bending vibration in the neighborhood of the tip of a free end of a cantilever construction, where $\lambda$ is given by the following expression: $\lambda=\{8\pi\sigma/(\rho fe^2)\}^{1/3}\times10^4$ ($\mu$m), where $\sigma$ is an ink surface tension (mN/m), $\rho$ is an ink density (g/cm$^3$), and fe is an excitation frequency (Hz).

3 Claims, 9 Drawing Sheets

RECORDING HEAD

BACKGROUND OF THE INVENTION

1. Field of the Invention

The present invention relates to a recording head for carrying out printing by jetting ink drops for deposition at predetermined positions on recording media.

2. Description of the Prior Art

A method involving the use of a nozzle is typical of an ink-jet recording method which carries out printing by jetting liquid drops, particularly ink drops on a printing surface. Conventionally, the on-demand type and the continuous flow type are known as the nozzle-type recording method.

The on-demand-type method is used for printing in a manner that jets ink intermittently from a nozzle in accordance with recording information; it is primarily classified into the piezoelectric vibrator type and the thermal type. The piezoelectric vibrator type applies a pulse voltage to a piezoelectric element provided in an ink chamber to deform the piezoelectric element, thereby causing a change in ink liquid pressure within the ink chamber and jetting ink drops from the nozzle to record dots on recording sheets. The thermal type heats ink by a heating element provided within the ink chamber and jets ink drops from the nozzle by resulting bubbles to record dots on recording sheets.

On the other hand, the continuous flow type applies pressure to ink to continuously jet the ink from a nozzle, and at the same time applies vibration by means of a piezoelectric vibrator or the like to convert the jetted ink stream into liquid drops, and selects the liquid drops to apply electric charges and deflection for recording.

In any of these methods, the diameter of ink drops depends primarily on a nozzle diameter. Reducing the nozzle diameter poses problems, for example, that the nozzle is clogged by dust and dirt or a dry ink surface of the nozzle, or that the ink jet direction is changed due to residual ink deposited on the nozzle circumferential portions On the other hand, several recording methods are proposed to perform printing by jetting ink drops on a printing surface instead of using a nozzle. For example, as disclosed in U.S. Pat. No. 4,308,547, there is a recording method by which a piezoelectric shell of sphere shape, curved in a concave shape, is disposed in ink and a voltage is applied to the piezoelectric shell via an electrode. In this method, longitudinal waves radiated into ink from the piezoelectric shell are converged at a point on the ink free surface and drops are jetted from the ink free surface.

As disclosed in Japanese Published Examined Patent Application No. Hei 6-45233, there is also a recording method by which a spherical concavity provided on a substrate such as glass is used as an acoustic lens and a vibrator consisting of a piezoelectric material and an electrode for applying voltage thereto is formed on the back of the substrate so that the vibrator is disposed in ink.

Further, there is disclosed in Japanese Published Unexamined Patent Application No. Hei 3-200199 a recording method by which a phase Fresnel lens of a thin film flat shape, as a more inexpensive lens capable of obtaining sharper focus, is mounted on the substrate in place of a concave lens.

According to the above mentioned method by which longitudinal waves are converged at an ink free surface so that drops are jetted from the ink free surface, the diameter of the drops is almost equal to the focusing diameter of the longitudinal waves, and the focusing diameter d is represented by d=F/f when the driving frequency of a vibrator is f and the F value of lens is F When the wavelength of longitudinal waves traveling through ink is represented by $\lambda$ and their traveling velocity by v, there is a relation $v=f\cdot\lambda$ between these and the driving frequency f of the vibrator.

Therefore, in the case of attempting to jet ink drops whose diameter (focusing diameter) d is as small as about 15 $\mu$m, when the F value of lens is 1, since the speed v of longitudinal waves traveling through conventional water base ink with low viscosity is almost 1500 m/s, the driving frequency f of the vibrator must be set to a very high frequency such as about 100 MHz Since it is practically difficult to select a remarkably small value as the F value of the lens because of various problems, it follows that an attempt to select a smaller value as a drop diameter d generally requires that the vibrator be driven with a higher frequency.

As described above, the method by which longitudinal waves are converged on an ink free surface to jet drops from the ink free surface poses a problem of cost that driving means are generally expensive because a plurality of vibrators have to be driven at a frequency as high as about 100 MHz, and serious problems such as a change in a drop diameter caused by changed ink viscosity due to heating by absorption, and the disabled ink jetting capability due to ink that runs dry or solid within recording elements.

As another prior art, a novel recording method of on-demand type is disclosed in Japanese Published Unexamined Patent Application No. Hei 6-340070. This method brings a beam of a cantilever construction into resonance by bending vibration to cause sufficient amplitude to occur at the tip of the beam so that ink is jetted; it is a recording method which allows ink to be jetted at a relatively low driving frequency and a low voltage. However, since this method employs a mechanism which forms ink drops via a nozzle provided at a beam tip, the drop diameter depends on a nozzle diameter like a variety of recording methods described previously, so that this method has a problem that a reduced nozzle diameter would cause nozzle clogging and a change in an ink jet direction due to ink residuals deposited on the nozzle circumferential portions. Although the art disclosed by the Japanese Published Unexamined Patent Application No. Hei 6-340070, as one of technical problems to be solved, intends to reduce the possibility of nozzle clogging in comparison with conventional methods, it provides no fundamental solution because a drop diameter depends on a nozzle diameter.

As still another prior art, which is not the ink jet recording method, a method for transforming liquid into particles by energizing vibration energy is disclosed in Japanese Published Unexamined Patent Application No. Hei 3-154665. This method, which was made to apply to an atomizing apparatus, consists of a vibrator containing piezoelectric ceramics and a vibration section, secured to the vibrator, which makes bending vibration in the form of cantilever, and generates foggy liquid drops by radiation of supersonic waves with part of the vibration section immersed in liquid. However, the art used for the atomizing apparatus cannot apply to an ink jet recording apparatus which requires ink drops to be accurately deposited in specified positions of recording media, because a number of drops not controlled in terms of time and space are generated though minute drops can be generated without using a nozzle.

Thus, there occurs a problem that it is becoming difficult to accurately record images in increasing demand for higher definition in recent years on recording media such as paper, no matter what conventional recording methods or what arts in other fields such as atomizing apparatuses and the like are used.

SUMMARY OF THE INVENTION

An object of the present invention is to provide a recording head which allows minute drops to be jetted without using a nozzle to record high-definition images, thus solving the problems not solvable by the above mentioned prior arts. Another object of the present invention is to provide a recording head capable of printing by low-frequency, low-voltage driving resistant to heating.

The above mentioned objects are achieved by a recording head comprising a vibration generating means vibrating in response to a pixel signal and an elastic member vibrating in accordance with the excitation of the vibration generating means, wherein capillary waves are generated on an ink surface by vibration of the elastic member to jet ink for deposition on recording media. In the recording head of the present invention, the elastic member is of a cantilever construction that bending vibration is made by excitation. Also, the elastic member has a length of about $2\lambda$ as the width of a side perpendicular to a vibration direction of bending vibration in the neighborhood of the tip of a free end of a cantilever construction. $\lambda$ is given by the following expression 1.

$$\lambda=\{8\pi\sigma/(\rho fe^2)\}^{1/3}\times10^4(\mu m) \qquad \text{Expression 1}$$

where $\sigma$ is an ink surface tension (mN/m), $\rho$ is an ink density ($g/cm^3$), and fe is an excitation frequency (Hz).

DESCRIPTION OF THE PREFERRED EMBODIMENTS

Figure 1A:
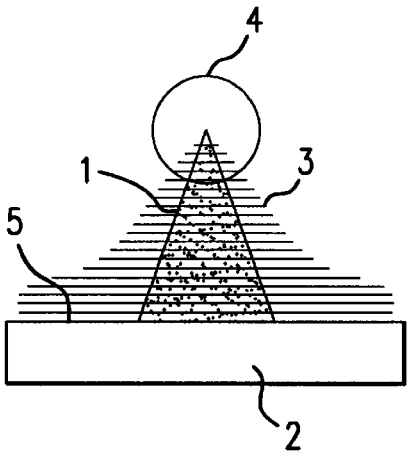
FIG. 1 shows a rough configuration of a recording head according to a first embodiment of the present invention.
Figure 1B:
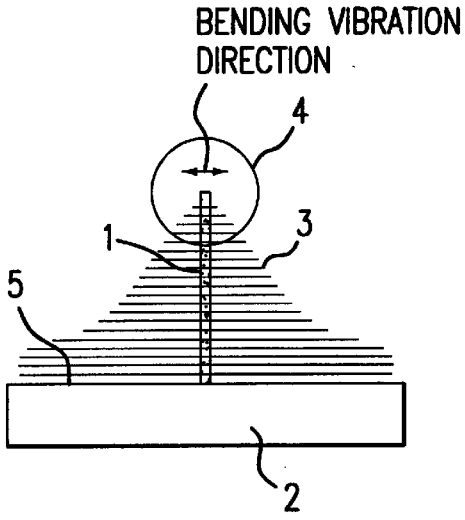
Figure 1C:
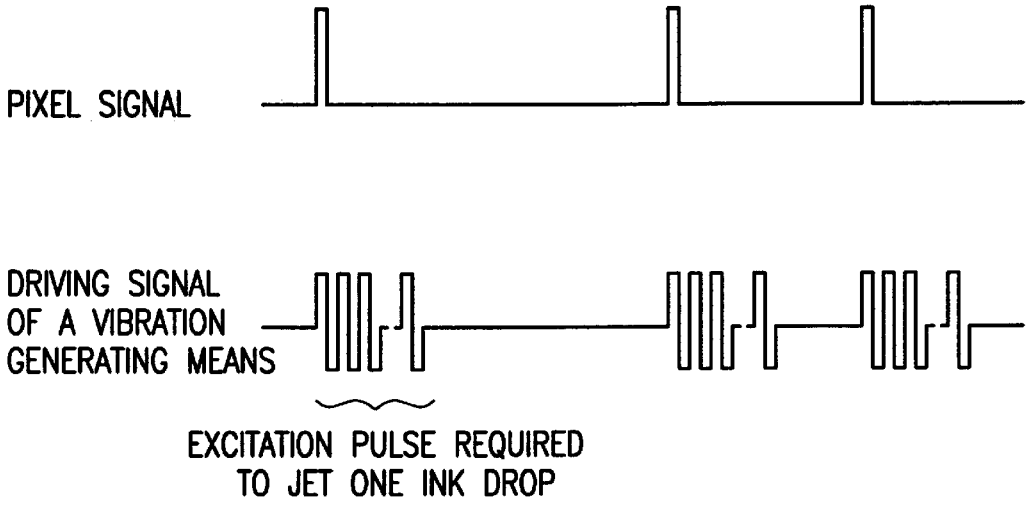
Figure 2A:
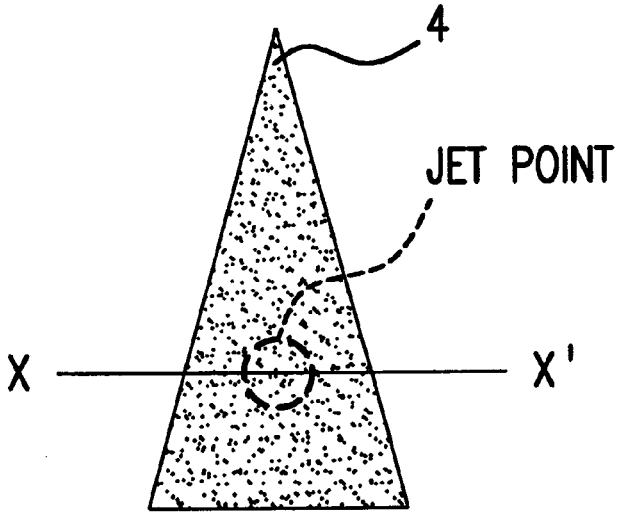
FIG. 2 describes an ink 3 jet operation in the neighborhood of the tip 4 of an elastic member 1 in a recording head according to a first embodiment of the present invention.
Figure 2B:
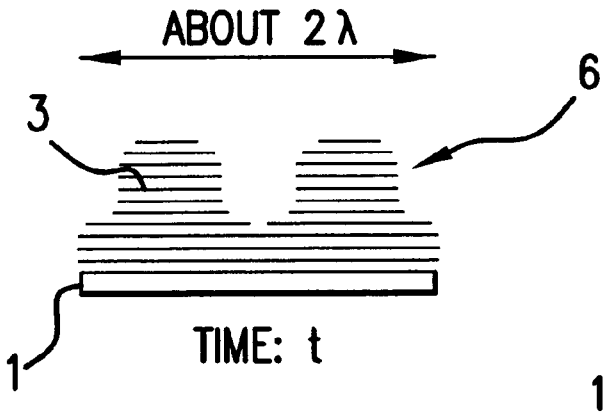
Figure 2C:
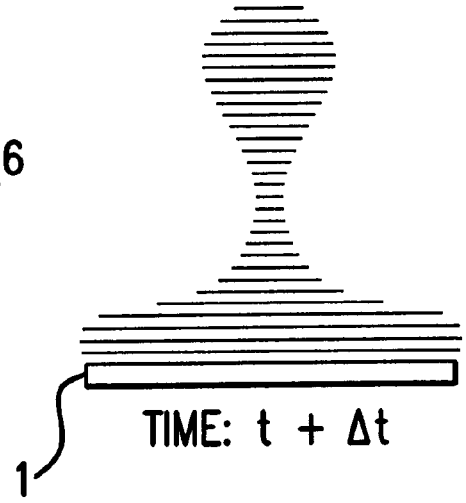

A recording head according to a first embodiment of the present invention will be described with reference to FIGS. 1 and 2. First, a rough configuration of a recording head according to the present embodiment will be described using FIG. 1. FIGS. 1(*a*) and 1(*b*) are an elevation view and a side view, respectively, which show a relationship among an elastic member 1, a vibration generating section 2, and ink 3. FIG. 1(*c*) shows the relationship between an image signal and the excitation of the vibration generating section 2. The recording head according to the present embodiment is of a cantilever construction that the elastic member 1 is connected to the vibration generating section 2 and a connection portion thereof is used as a base 5, and at least the neighborhood of the tip 4 contacts with ink 3. The elastic member 1 is of a cantilever construction that, when viewed from the front, it is of a triangular shape with the base 5 as the bottom, and when viewed from sides, it is of a rectangular shape with almost equal plate thickness. The vibration generating section 2 is excited at a frequency causing resonance in the elastic member 1 with bending vibration and the neighborhood of the tip 4 of the elastic member 1 has a large amplitude as a result of the resonance. This causes ink 3 to be exposed to a strong effect of vibration so that capillary waves are generated on a surface thereof. Minute drops can be generated by the effect of the capillary waves.

In order to make one minute drop be stably jetted in this configuration, it is important to place ink 3 in an area of a certain size so that capillary waves can be generated in the neighborhood of the tip 4 of the elastic member 1. For this reason, when the width of the elastic member 1 at a side perpendicular to a bending vibration direction is w and a value calculated by the above expression 1 is $\lambda$, the width (w) of at least part of the neighborhood of the tip 4 is set to about $2\lambda$. A desirable width w is in the range from $1.2\lambda$ to $2.4\lambda$.

The above expression 1 is described in commercially available references, for example, as an expression for finding the wavelength of capillary waves in Section 2 in Chapter 7 of "Ultrasonic Spray" written by Chikashi Chiba (Sankaido Publishing Co., Ltd.).

The elastic member 1 can be any member that, in addition to having the characteristics of the neighborhood of the above mentioned tip 4, is capable of transforming the vibration of the vibration generating section 2 into bending vibration and is capable of generating amplitude enough to jet drops in the neighborhood of the tip 4. Although there are no special limitations on material, shape, etc., metallic materials such as SUS and Ni, and polymeric materials such as polyimide resin, PET, epoxy resin, and cyanoacrylate resin are desirable.

To protect the elastic member 1 from deterioration, corrosion, and foreign matter, it is effective to cover its surface with metal such as gold, platinum, palladium, and rhodium, and the like, and a thin film such as PTFE.

The vibration generating section 2 can be whatever generates vibration in accordance with an electrical signal inputted from a driving circuit not shown; piezoelectric materials, magnetostrictive materials, mechanical actuators, and actuators applying electrostatic force, and the like are applicable. Of these, particularly, piezoelectric materials, widely used as the functional materials of ink-jet printer, are most suitable because advanced manufacturing technology is established.

The following can be used as piezoelectric materials: polycrystalline substances and single-crystal substances such as crystal, PZT, barium titanate $BaTiO_3$, niobate $PbNb_2O_6$, bismuthgermanate $Bi_{12}GeO_{20}$, lithium niobate $LiNbO_3$, and tantalic acid lithium $LiTaO_3$, or piezoelectric thin films such as ZnO and AlN, or piezoelectric high polymers such as polyurea, PVDF (polyvinylidene fluoride), and copolymers of PVDF, or complexes of inorganic piezoelectric substances and piezoelectric high polymers such as PZT. Of course, optimum piezoelectric materials must be selected in accordance with a driving frequency set when designing the recording head. If the frequency of an alternate current applied is in the range from tens of kilohertz to 1 MHz, ceramics such as PZT are preferred, and in the case of driving at a higher frequency, piezoelectric thin films suitable for high frequencies, such as ZnO, are selected. In either case, materials having vibration characteristics to produce stable and sufficient vibration are required. The elastic material 1 can also be formed by a piezoelectric material itself constituting the vibration generating section 2.

In order that one ink drop is jetted in accordance with one pixel signal, the excitation of the vibration generating section 2 is intermittently stopped each time the number of excitations required to jet one ink drop terminates.

As shown in FIG. 1(*c*), for excitation in the present embodiment, burst waves are used which have waveform signals consisting of a string of at least one or more waveforms with an excitation cycle as one cycle and intermittently apply these in accordance with image signals. The burst waves can be sine waves, chopping waves, and the like, in addition to the rectangular waves shown in the figure.

The energy for jetting ink 3 depends on the number of waveforms (called a burst count) with the excitation cycle of the vibration generating section 2 as one cycle and an applied voltage. An increase in a burst count enables ink to be jetted at a relatively low voltage, and a decrease in a burst count increases voltage a little but enables ink to be jetted at a higher speed.

Next, the ink jet operation of ink 3 in the neighborhood of the tip 4 of the elastic member 1 will be described with reference to FIG. 2. FIG. 2(*a*) is an enlarged view of the neighborhood of the tip 4 of the elevation view of the elastic member 1 shown in FIGS. 1(*a*) and (*b*), and the circular area shown by the dashed line in the figure indicates a ink jet point. FIGS. 2(*b*) and (*c*), which are sectional views along a line X–X' crossing the ink jet point shown in FIG. 2(*a*), show a state immediately before ink is jetted. FIG. 2(*b*) shows the state of ink 3 at a certain time t after the start of excitation of the vibration generating section 2, indicating the moment that a capillary wave 6 having two mountains occurs in an area with a width of about 2λ at a side perpendicular to a bending vibration direction in the neighborhood of the tip 4 of the elastic member 1. FIG. 2(*c*) shows the state of ink 3 after a time of Δt elapses from FIG. 2(*b*). An ink upheaval of one mountain is formed between the two mountains of the capillary wave 6 shown in FIG. 2(*b*), and at the next moment is separated to jet one ink drop.

If the elastic member 1 is about 1λ or less in width at a side perpendicular to a bending vibration direction in the neighborhood of the tip 4 thereof, the capillary wave becomes difficult to occur, so that drops are not jetted without increasing the excitation voltage of the vibration generating section 2 or a burst count. Even though the drops are jetted, no stable drop jet is obtained.

The capillary wave 6 is difficult to occur also when the elastic member 1 is about 3λ or more in width at a side perpendicular to a bending vibration direction. Like the above mentioned case, the capillary wave can be generated by increasing the excitation voltage of the vibration generating section 2 or a burst count, but in that case, three or more mountains of the capillary wave are generated and a plurality of drops are jetted, making it difficult for one ink drop to be stably jetted.

As described above, according to a recording head of the present embodiment, which includes an area having a width of about 2λ at a side perpendicular to a bending vibration direction of the neighborhood of the tip 4 of the elastic member 1, minute drops can be generated without using a nozzle and high-quality recording can be carried out without ink being clogged.

Figure 3A:
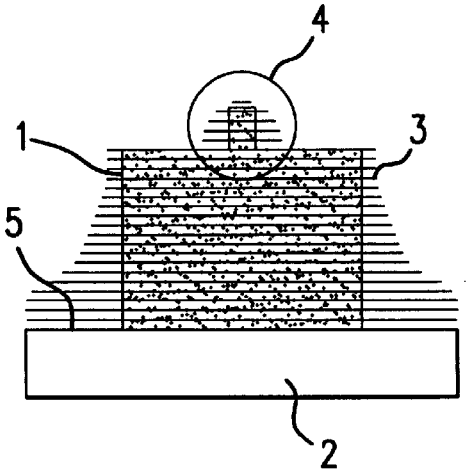
FIG. 3 shows a rough configuration of a recording head according to a second embodiment of the present invention.
Figure 3B:
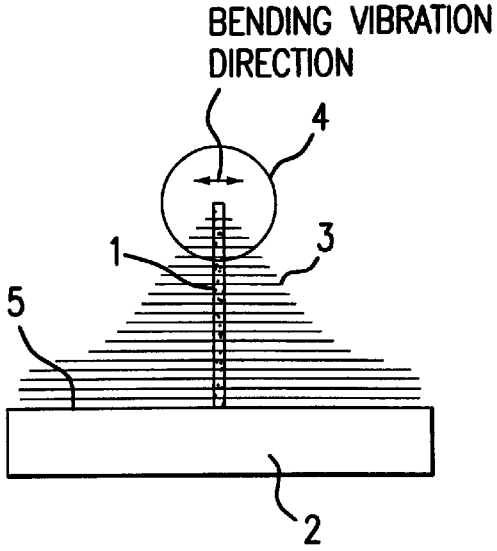
Figure 3C:
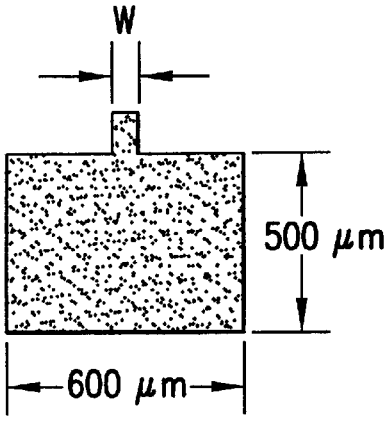

Next, a recording head according to a second embodiment of the present invention will be described using FIGS. 3 and 4. Identical reference numerals are assigned to the constituent members having the same function as the recording head of the first embodiment. FIG. 3(*a*) is an elevation view of a recording head according to the present embodiment and FIG. 3(*b*) is a side view thereof. The elastic member 1 in the present embodiment is of a construction that a projecting tip 4 of rectangular shape is formed near the center of the end of a parallel plate stretching from the base 5 to the tip 4. For example, the dimensions of the elastic member are such that, as shown in FIG. 3(*c*), the plate has dimensions of 600 μm in the length of the bottom of the base 5, 500 μm in height, and 7 μm in thickness, and the tip 4 has dimensions of 50 μm in width w, 100 μm in height, and 7 μm in thickness. The following can be used as materials of the elastic member 1: Al, Fe, Ti, Cr, Au, Mo, TiW, etc. or different types of alloys thereof, or $SiO_2$, SiON, SiN, AlN, $Al_2O_3$, and other inorganic materials, and different types of resins such as cyanoacrylate resin, epoxy resin, and fluorocarbon resin. In the present invention, SUS is used as the material of the elastic member 1.

Ink having the following physical properties (density ρ and surface tension σ) is used for ink 3:

$\rho=1.05\ g/cm^3$ $\sigma=30\ mN/m$

In this configuration, if the vibration generating section 2 is excited with an excitation frequency fe set to 193 kHz, the tip 4 of the elastic member 1 is subjected to bending vibration as shown by the arrow in FIG. 3(*b*), so that a single drop of ink 3 is stably jetted from the neighborhood (an ink jet point) of the center of the tip 4 of the elevation view shown in FIG. 3(*a*).

Figure 4A:
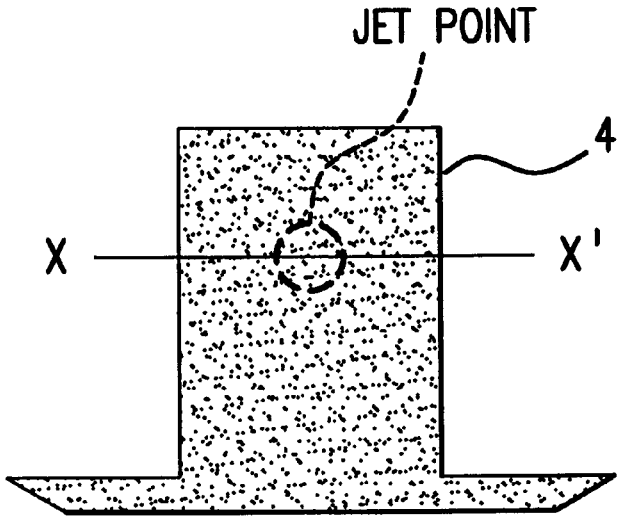
FIG. 4 describes an ink 3 jet operation in the neighborhood of the tip 4 of an elastic member 1 in a recording head according to a second embodiment of the present invention.
Figure 4B:
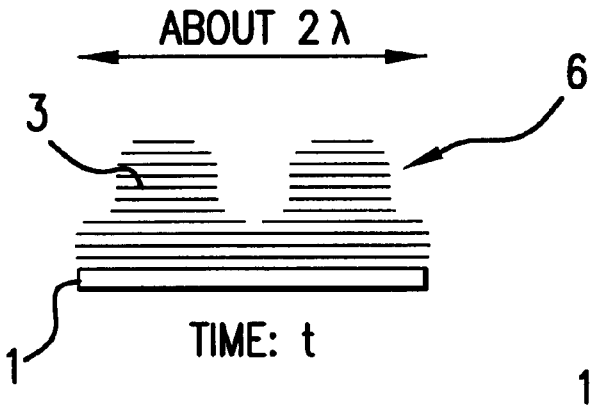
Figure 4C:
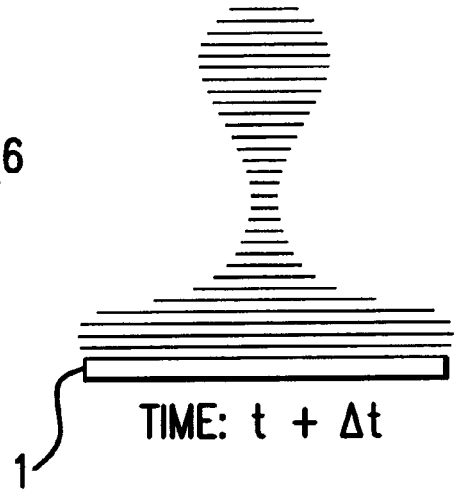

FIG. 4 shows a state when ink is jetted. FIGS. 4(*b*) and (*c*), which are sectional views along a line X–X' crossing the circular ink jet point shown by a dashed line in FIG. 4(*a*), show a state immediately before ink is jetted during stable single jetting.

FIG. 4(*b*) shows the state of ink 3 at a certain time t after the start of excitation of the vibration generating section 2, indicating the moment that a capillary wave 6 having two mountains occurs at the X–X' cross section of a side perpendicular to a bending vibration direction in the neighborhood of the tip 4 of the elastic member 1.

FIG. 4(*c*) shows the state of ink 3 after a time of Δt elapses from FIG. 4(*b*). An ink upheaval of one mountain is formed between the two mountains of the capillary wave 6 shown in FIG. 4(*b*), and at the next moment is separated to jet one ink drop. This state is extremely stable, and two mountains of the capillary wave 6 never fail to occur immediately before one ink drop is jetted.

On the other hand, as the result of assigning the values of density ρ, surface tension σ, and excitation frequency fe of ink 3 in the present embodiment to the above expression 1, λ is set to a value of 27 μm. Accordingly, the width (w) (=50 μm) of the tip 4 of the elastic member 1 providing stable jets becomes equal to 1.9λ, which is almost equal to 2λ. The voltage applied to the vibration generating section 2 at this time is 37 V.

Here, ink jet operations were compared between an elastic member 1 whose tip 4 is 80 μm in width (w) and an elastic member 1 with w set equal to 30 μm. The respective elastic members 1 are designed so that bending vibration is brought into resonance when fe is 193 kHz, and are adjusted so that the tips 4 of the respective elastic members 1 vibrate with a sufficient amplitude in that condition. As a result, with the elastic material 1 with w set equal to 80 μm, a plurality of ink drops were jetted, and with the elastic member 1 with w set equal to 30 μm, ink jet operations were very unstable. If the width w of the tips 4 of these elastic members 1 is represented by λ in the expression 1, w is 2.96λ for 80 μm and 1.11λ for 30 μm, which are improper as the ink jet capability of a recording head.

Using ink 3 having the above described physical properties and three types of elastic members 1 whose tip 4 is 30, 40, and 80 μm in width (w), when the excitation frequency fe of the vibration generating section 2 is set to 115 kHz, ink jet operations were observed with the following result. The three types of elastic members 1 are each designed to be brought into resonance when fe is 115 kHz. Of these elastic members, only in the case of the elastic member 1 whose tip 4 is 80 μm in width (w), a single drop is stably jetted. In this case, as shown in FIG. 4, a capillary wave 6 of two mountains never fails to occur immediately before one ink drop is jetted in the X–X' cross section of a side perpendicular to a bending vibration direction in the neighborhood of the tip 4 of the elastic member 1.

As the result of assigning the physical properties of the above described ink 3 and an excitation frequency to the expression 1, λ is set to 38 μ. Accordingly, the width (w) of the tip 4 of the elastic member 1 providing stable jets becomes equal to 2.1λ, which is almost equal to 2λ. The voltage applied to the vibration generating section 2 at this time is 27 V.

On the other hand, when the width (w) of the tip 4 is 30 μm, w is set to 0.79λ by the expression 1, and when the width (w) of the tip 4 is 40 μm, w becomes equal to 1.05λ, indicating that these elastic members 1 would make ink jet unstable.

Next, with the density p and surface tension σ of ink 3 changed as follows, an example using ink 3 having the following physical properties will be described:

$\rho$=1.05 g/cm$^3$ $\sigma$=44 mN/m

Using three types of elastic members 1 whose tips are 30, 50, and 80 μm in width, respectively, and which are brought into resonance at 113 kHz, an experiment was carried out by generating an excitation frequency of 113 kHz in the vibration generating section 2. As a result, only in the case of the elastic member 1 whose tip 4 is 80 μm in width (w), a single drop was stably jetted.

In this case as well, as shown in FIG. 4, a capillary wave 6 of two mountains never failed to occur immediately before one ink drop was jetted in the X–X' cross section of a side perpendicular to a bending vibration direction in the neighborhood of the tip 4 of the elastic member 1.

In this case, when the physical properties (density ρ and surface tension σ) of ink 3 and an excitation frequency fe are assigned to the expression 1 to find λ, λ becomes equal to 44 λm. Accordingly, the width (w) (=80 μm) of the tip 4 of the elastic member 1 providing stable jets becomes equal to 1.8λ, which is also almost equal to 2λ. The voltage applied to the vibration generating section 2 at this time is 25 V.

On the other hand, the elastic members 1 whose tip 4 is 0.68λ (=30 μm) or 1.14λ (=50 μm) in width (w) make ink jet unstable.

In this way, stable single jets of ink 3 require that a capillary wave 6 of two mountains be formed immediately before; two mountains of the capillary wave 6 of two mountains are formed in an area having a width of about 2λ at a side perpendicular to a bending vibration direction in the neighborhood of the tip 4 immediately before a stable single jet.

Therefore, according to a recording head of the present embodiment, which has an area having a width of about 2λ at a side perpendicular to a bending vibration direction in the neighborhood of the tip 4, minute drops can be generated without a nozzle and high-quality recording can be carried out without ink being clogged.

Figure 5A:
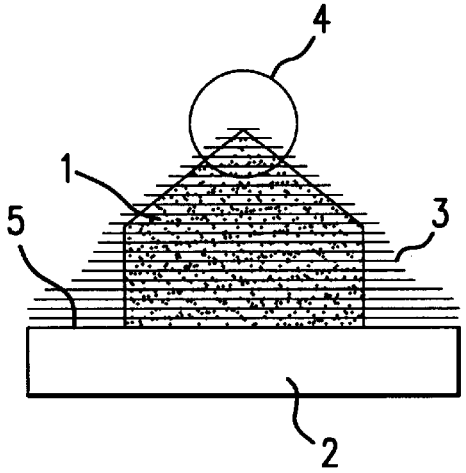
FIG. 5 shows a rough configuration of a recording head according to a third embodiment of the present invention.
Figure 5B:
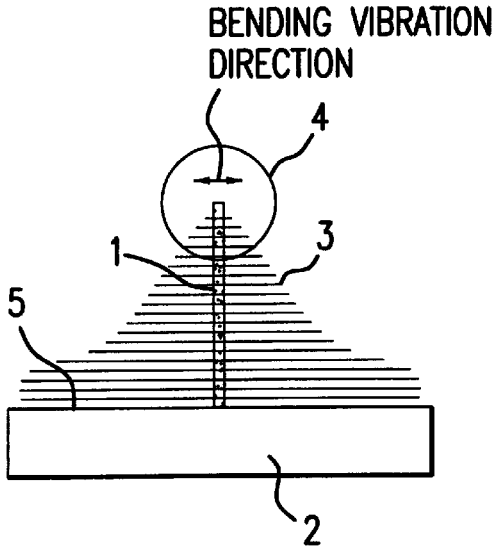
Figure 5C:
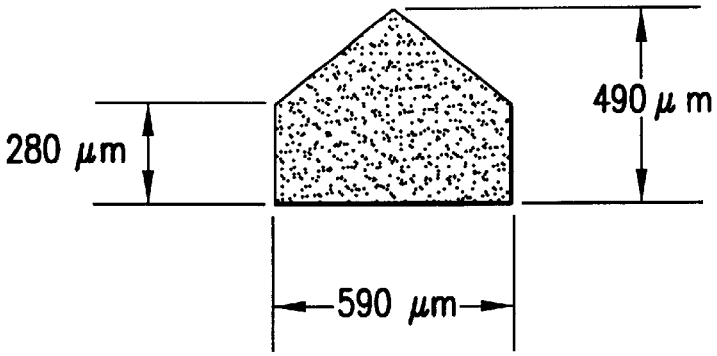

Next, a recording head according to a third embodiment of the present invention will be described using FIGS. 5 and 6. In the present embodiment as well, identical reference numerals are assigned to the constituent members having the same function as the recording head of the first embodiment. FIG. 5(*a*) is an elevation view of a recording head according to the present embodiment and FIG. 5(*b*) is a side view thereof. The elastic member 1 according to the present embodiment, as shown in FIGS. 5(*a*) and (*c*), is of a front shape that an isosceles triangle with a bottom of 590 μm and a height of 280 μm is mounted on the top of a rectangle whose base 5 is 590 μm in length and whose height is 280 μm, and is of a cantilever construction that its thickness is almost uniformly 7 μm. Accordingly, the elastic member 1 according to the present embodiment has a sharp tip. In the present embodiment, SUS is used as the material of the elastic member 1. Ink having the physical properties (density ρ and surface tension σ) shown below is used for ink 3.

$\rho$=1.05 g/cm$^3$ $\sigma$=30 mN/m

In this configuration, exciting the vibration generating section 2 at an excitation frequency fe of 193 kHz causes the tip 4 of the elastic member 1 to make bending vibration in the direction of the arrow shown in FIG. 5(*b*) and ink 3 to make stable single jets from the neighborhood of the center of the tip 4 of the elevation view shown in FIG. 5(*a*).

Figure 6A:
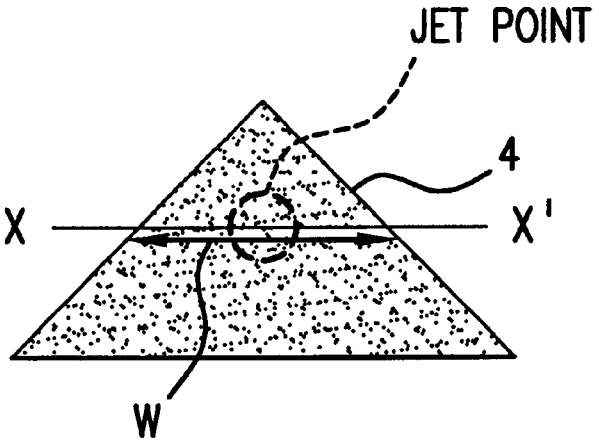
FIG. 6 describes an ink 3 jet operation in the neighborhood of the tip 4 of an elastic member 1 in a recording head according to a third embodiment of the present invention.
Figure 6B:
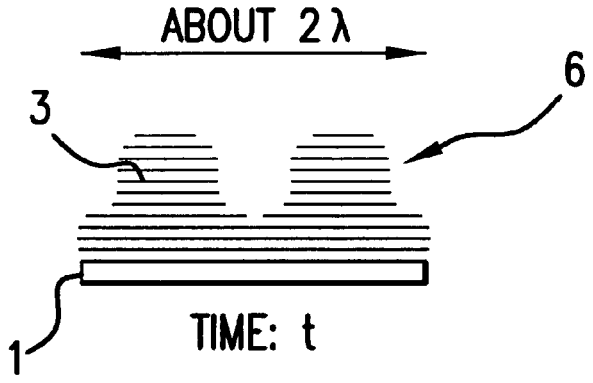
Figure 6C:
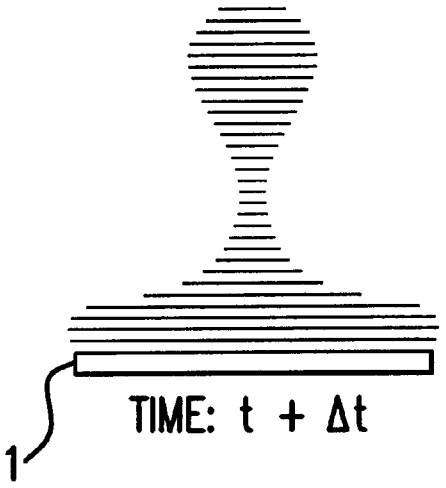

FIG. 6 shows an ink jet operation by the recording head according to the present embodiment. FIG. 6(*a*) is an elevation view of the elastic member 1 of the recording head according to the present embodiment in the neighborhood of the tip 4 thereof. The circular area indicated by the dashed line in FIG. 6(*a*) shows the neighborhood of an ink jet point. FIGS. 6(*b*) and (*c*), which are cross-sectional views along the line X–X' crossing the ink jet point in FIG. 6(*a*), shows a state immediately before an ink jet operation when ink 3 makes stable single jets.

FIG. 6(*b*) shows the state of ink 3 at a certain time t after the start of excitation of the vibration generating section 2, indicating the moment that a capillary wave 6 having two mountains occurs at the X–X' cross section of a side perpendicular to a bending vibration direction in the neighborhood of the tip 4 of the elastic member 1.

FIG. 6(*c*) shows the state of ink 3 after a time of Δt elapses from FIG. 6(*b*). An ink upheaval of one mountain is formed between the two mountains of the capillary wave 6 shown in FIG. 6(*b*), and at the next moment is separated to jet one ink drop. Like the first embodiment, this state is very stable and a capillary wave 6 of two mountains never fails to occur immediately before one ink drop is jetted.

When a voltage applied to the vibration generating section 2 is changed from 12 V to 23 V, the ink 3 jet point indicated by the circular dashed line in FIG. 6(*a*) moves somewhat vertically. At this time, if the width of an X–X' cross section crossing the ink jet point is w and a value obtained by the expression 1 is λ, the value of w when a stable jet of a single ink drop was realized is 1.6 to 2.4λ, indicating a value almost close to 2λ.

When a voltage lower than 12 V is applied, no ink 3 is jetted from any position of the elastic member 1, and when a voltage higher than 23 V is applied to the vibration generating section 2, the first ink drop is jetted from the position of the above w, but after this, unsuitably as a recording head, second and third ink jets occur successively.

In this way, if the tip 4 of the elastic member 1 is made sharp as shown in FIG. 6(*a*), there can always be provided an area that the width of a side perpendicular to a bending vibration direction in the neighborhood of the tip 4 of the elastic member 1 is about 2λ. Therefore, according to the recording head of the present embodiment, like the first and second embodiments, minute drops can be generated without a nozzle and high-quality recording can be carried out without ink being clogged, and additionally, it becomes possible to manufacture the elastic member 1 whose tip 4 can be processed with a lower manufacturing precision than that of the elastic member 1 in the second embodiment so that ink 3 can be stably single-jetted.

Figure 7A:
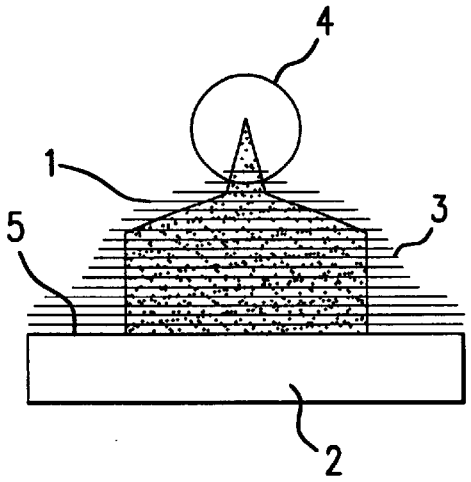
FIG. 7 shows a rough configuration of a recording head according to a fourth embodiment of the present invention.
Figure 7B:
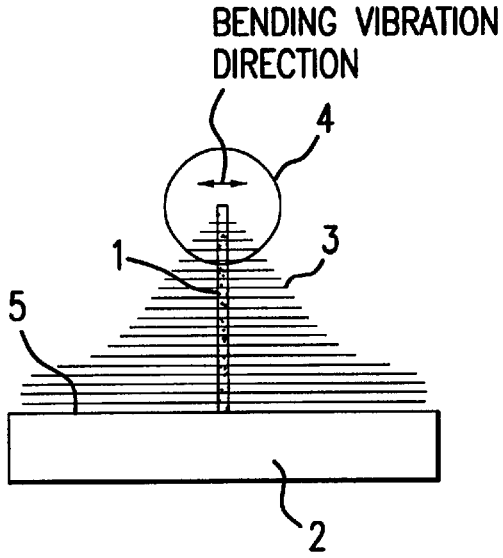
Figure 7C:
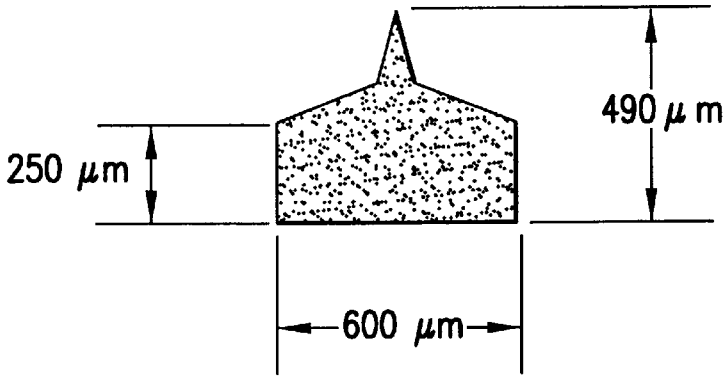

Next, a recording head according to a fourth embodiment of the present invention will be described using FIGS. 7 and 8. In the present embodiment as well, identical reference numerals are assigned to the constituent members having the same function as the recording head of the first embodiment. FIG. 7(*a*) is an elevation view of a recording head according to the present embodiment and FIG. 7(*b*) is a side view thereof. The elastic member 1 according to the present embodiment, as shown in FIGS. 7(*a*) and (*c*), is of a front shape that two isosceles triangles with a bottom of 600 μm and a height of 240 μm in total are mounted on the top of a rectangle whose base 5 is 600 μm in length and whose height is 250 μm, and is of a cantilever construction that its thickness is almost uniformly 7 μm. Accordingly, the elastic member 1 according to the present embodiment has a sharper tip 4 than the tip of the elastic member 1 of the third embodiment, and is of a shape that there are discontinuous points from the tip 4 to the base 5. In the present embodiment as well, SUS is used as the material of the elastic member 1. Ink having the same physical properties as with the third embodiment is used for ink 3.

In this configuration, exciting the vibration generating section 2 at an excitation frequency fe of 193 kHz causes the tip 4 of the elastic member 1 to make bending vibration in the direction of the arrow shown in FIG. 7(*b*) and ink 3 to be stably single-jetted from the neighborhood of the center of the tip 4 of the elevation view shown in FIG. 7(*a*).

Figure 8A:
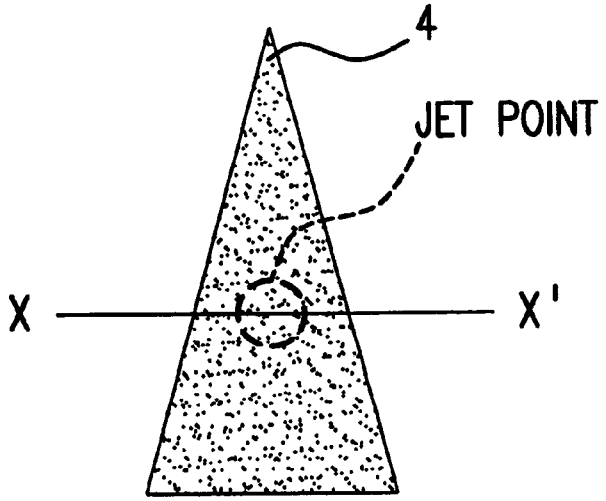
FIG. 8 describes an ink 3 jet operation in the neighborhood of the tip 4 of an elastic member 1 in a recording head according to a fourth embodiment of the present invention.
Figure 8B:
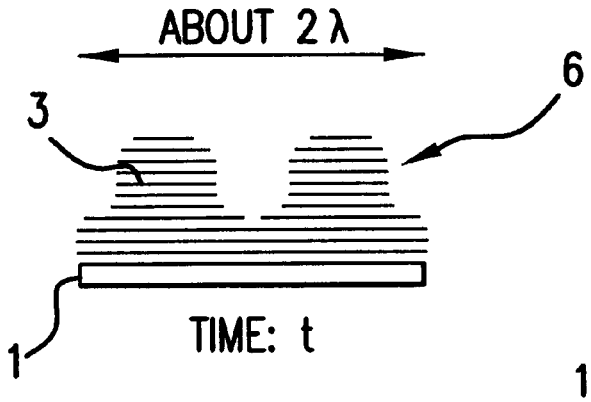
Figure 8C:
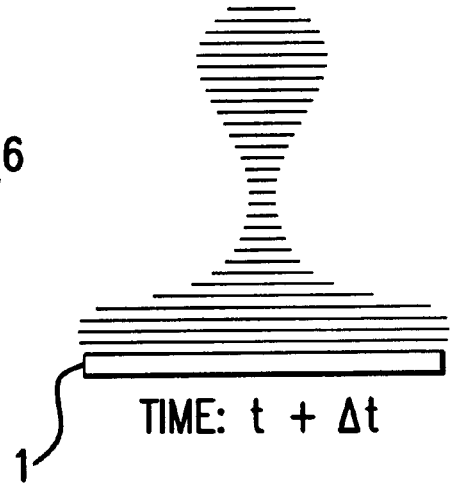
Figure 9A:
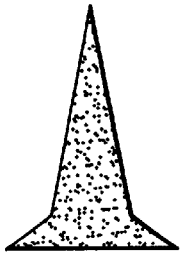
FIG. 9 shows examples of variations of the shape of an elastic member in the present invention.
Figure 9B:
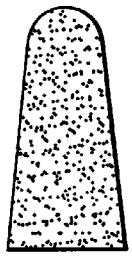
Figure 9C:
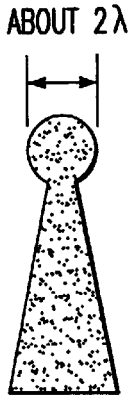
Figure 9D:
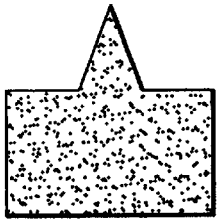
Figure 9E:
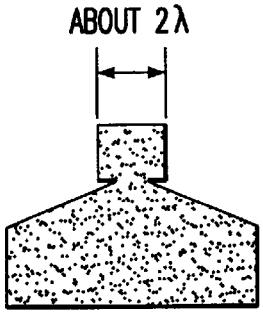
Figure 9F:
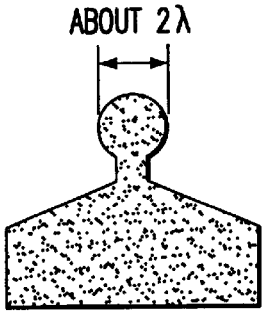

FIG. 8 shows an ink jet operation by the recording head according to the present embodiment. FIG. 8(*a*) is an elevation view of the elastic member 1 of the recording head according to the present embodiment in the neighborhood of the tip 4 thereof. The circular area indicated by the dashed line in FIG. 8(*a*) shows the neighborhood of an ink jet point. FIGS. 8(*b*) and (*c*), which are cross-sectional views along the line X–X' crossing the ink jet point in FIG. 8(*a*), show a state immediately before an ink jet operation when ink 3 makes stable single jets.

FIG. 8(*b*) shows the state of ink 3 at a certain time t after the start of excitation of the vibration generating section 2, indicating the moment that a capillary wave 6 having two mountains occurs at the X–X' cross section of a side perpendicular to a bending vibration direction in the neighborhood of the tip 4 of the elastic member 1.

FIG. 8(*c*) shows the state of ink 3 after a time of Δt elapses from FIG. 8(*b*). An ink upheaval of one mountain is formed between the two mountains of the capillary wave 6 shown in FIG. 8(*b*), and at the next moment is separated to jet one ink drop. Like the first embodiment, this state is very stable and two mountains of the capillary wave 6 never fail to occur immediately before one ink drop is jetted.

When a voltage applied to the vibration generating section 2 is changed from 18 V to 39 V, the ink 3 jet point indicated by the circular dashed line in FIG. 8(*a*) moves somewhat vertically. At this time, if the width of an X–X' cross section crossing the ink jet point is w and a value obtained by the expression 1 is λ, the value of w when a stable jet of single ink drop was realized is 1.2 to 2.3λ, indicating a value almost close to 2λ.

When a voltage lower than 18 V is applied, no ink 3 is jetted from any position of the elastic member 1, and when a voltage higher than 39 V is applied to the vibration generating section 2, the first ink drop is jetted from the position of the above w, but after this, unsuitably as a recording head, second and third ink jets occur successively.

In this way, if the tip 4 of the elastic member 1 is made sharp as shown in FIG. 8(*a*), like the third embodiment, there can always be provided an area that the width of a side perpendicular to a bending vibration direction in the neighborhood of the tip 4 of the elastic member 1 is about 2λ. Therefore, according to the recording head of the present embodiment, like the first and third embodiments, minute drops can be generated without a nozzle and high-quality recording can be carried out without ink being clogged, and additionally, it becomes possible to manufacture the elastic member 1 whose tip 4 can be processed with a lower manufacturing precision than that of the elastic member 1 in the second embodiment so that ink 3 can be stably single-jetted.

Since discontinuous points from the tip 4 to the base 5 of the elastic member 1 play a role of holding an ink level, according to the recording head of the present embodiment, an ink amount around the tip 4 can be kept constant regardless of a slight change in an ink amount around the elastic member 1, enabling more stable drop jets.

The present invention can have different variations in addition to the above described embodiments.

For example, in the above described first to fourth embodiments, although four types of elastic members 1 with different front shapes were described as examples, the present invention is not limited to them. As shown in FIGS. 9(*a*) to (*f*), for example, by using an elastic member 1 having an area about 2λ, wide at a side perpendicular to a bending vibration direction in at least part of the neighborhood of the tip 4 and transmitting a sufficient bending vibration to the neighborhood of the tip 4, a stable jet of a single ink drop can be made.

Figure 10A:
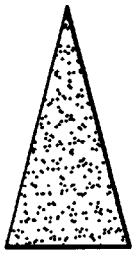
FIG. 10 shows examples of variations of the shape of an elastic member in the present invention.
Figure 10B:
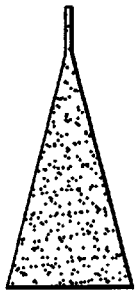
Figure 10C:
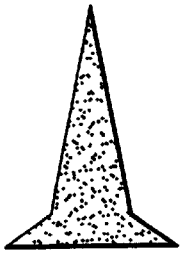

Moreover, as for the side shape of the elastic member 1, namely, plate thickness, since a sufficient bending vibration has only to be obtained in the neighborhood of the tip 4, the elastic members 1 to which the present invention is applicable are not limited to a plate structure of uniform plate thickness used in the above described first to fourth embodiments. The elastic members 1 having a shape that is widening toward the base 5 from the tip 4 as shown in FIGS. 10(*a*) to (*c*) are satisfactory. Advantageously, the structure widening toward the bottom as shown in FIG. 10 provides a sufficient mechanical strength in the neighborhood of the base 5 while presenting a sufficient bending vibration in the neighborhood of the tip 4 of the elastic member 1.

As described above, the elastic member 1 can be of a variety of shapes such as a bar shape and a pyramidal shape, as well as a plate shape with a uniform thickness, but it is desirable to turn at least the neighborhood of the tip 4 into a tongue shape in terms of stability of vibration, a drop jet direction, and ink holding.

Moreover, the elastic member 1 need not be composed of a single material or single member and may be of a complex structure consisting of a plurality of materials and members. The use of gradient materials whose physical properties (density, Young's modulus, etc.) change gradually depending on the location of members is also effective for compatibly delivering a plurality of different performances.

As described above, according to the present invention, minute drops can be jetted without using a nozzle, so that a recording head capable of recording high-definition images can be provided. Moreover, a recording head capable of printing by low-frequency, low-voltage driving resistant to heating can be provided.

What is claimed is:

1. A recording head, for use with a pixel signal generator and a quantity of ink, comprising:

vibration generating means vibrating in response to a pixel signal; and an elastic member vibrating in accordance with an excitation of said vibration generating means, wherein a capillary wave is generated on an ink surface of the elastic member by vibration so that a quantity of said ink is drawn towards a tip of the elastic member and ejected therefrom.

2. The recording head according to claim 1, wherein said elastic member is of a cantilever construction that bendingly vibrates due to the excitation.

3. The recording head according to claim 2, wherein said elastic member has a width of about $2\lambda$ as the width of a side perpendicular to a vibration direction of said bending vibration in the neighborhood of a tip of a free edge of said cantilever construction, where $\lambda$ is given by the expression shown below:

$$\lambda=\{8\pi\sigma/(\rho fe^2)\}^{1/3}\times 10^4(\mu m)$$

where $\sigma$ is an ink surface tension (mN/m), $\rho$ is an ink density (g/cm$^3$), and fe is an excitation frequency (Hz).

* * * * *